US007681780B2

(12) United States Patent
Bethke et al.

(10) Patent No.: US 7,681,780 B2
(45) Date of Patent: Mar. 23, 2010

(54) FOLDABLE POSTCARD FORM HAVING A REMOVABLE LABEL

(75) Inventors: Darvin R. Bethke, Forest Lake, MN (US); Lisa Spadoni, Madison, WI (US); James L. Warmus, La Grange, IL (US)

(73) Assignee: Moore Wallace North America, Inc., Stamford, CT (US)

( * ) Notice: Subject to any disclaimer, the term of this patent is extended or adjusted under 35 U.S.C. 154(b) by 1181 days.

(21) Appl. No.: 11/251,992

(22) Filed: Oct. 17, 2005

(65) Prior Publication Data

US 2006/0032896 A1 Feb. 16, 2006

Related U.S. Application Data

(63) Continuation-in-part of application No. 10/614,898, filed on Jul. 9, 2003, now Pat. No. 7,083,079, and a continuation-in-part of application No. 11/038,000, filed on Jan. 18, 2005, now abandoned.

(51) Int. Cl.

| | |
|---|---|
| ***B42D 15/00*** | (2006.01) |
| ***B65D 27/00*** | (2006.01) |
| ***B65D 27/06*** | (2006.01) |

(52) U.S. Cl. ..... 229/92.8; 229/92.3; 229/300

(58) Field of Classification Search ..... 229/92.1, 229/92.3, 92.8, 300

See application file for complete search history.

(56) References Cited

U.S. PATENT DOCUMENTS 5,167,998 A * 12/1992 Hato et al. ..... 428/77

(Continued)

FOREIGN PATENT DOCUMENTS

JP 02187396 A * 7/1990

(Continued)

OTHER PUBLICATIONS

Canadian Intellectual Property Office, "Office action," mailed Feb. 18, 2009, in connection with corresponding Canadian Application No. 2,557,052, 3 pages.

*Primary Examiner*—Jes F Pascua

(74) *Attorney, Agent, or Firm*—Hanley, Flight & Zimmerman, LLC

(57) ABSTRACT

Methods and apparatus for a double folded postcard form having a removable label are disclosed. An example form includes a quadrate sheet having parallel top and bottom edges, parallel first and second side edges perpendicular to the top edge and first and second faces. The example form also includes at least first, second, and third fold lines parallel to the top and bottom edges dividing the sheet into at least first, second, third and fourth panels, the first and fourth panels being substantially the same size and the second and third panels being substantially the same size. There is also an opening in at least one of the first, second, third and fourth panels, a liner attached to the first face of the at least one panel to cover at least a portion of the opening, and a label removably disposed on the liner in the opening. Furthermore, the form includes first adhesive areas provided on the second face of at least one of the first and fourth panels, and on the second face of at least one of the second and third panels for adhering mutually facing portions of the second and third panels together as respective first and second postcard plies when the sheet is double V-folded about the fold lines.

34 Claims, 6 Drawing Sheets

U.S. PATENT DOCUMENTS

| | | | | |
|---|---|---|---|---|
| 5,667,134 | A | 9/1997 | Olson et al. | |
| 5,752,647 | A * | 5/1998 | Schubert et al. | 229/92.1 |
| 5,836,622 | A * | 11/1998 | Fabel | 283/62 |
| 6,092,843 | A * | 7/2000 | Peterson et al. | 283/116 |
| 7,083,079 | B2 * | 8/2006 | Bethke | 229/92.8 |
| 2005/0001021 | A1 * | 1/2005 | Hutchinson | 229/300 |
| 2006/0157970 | A1 * | 7/2006 | Warmus | 283/81 |

FOREIGN PATENT DOCUMENTS

| | | | |
|---|---|---|---|
| JP | 11286187 | A * | 10/1999 |
| JP | 2002019335 | A * | 1/2002 |

* cited by examiner

FOLDABLE POSTCARD FORM HAVING A REMOVABLE LABEL

RELATED APPLICATIONS

This application is a continuation-in-part of U.S. patent application Ser. No. 10/614,898, which was filed on Jul. 9, 2003 now U.S. Pat. No. 7,083,079. This application is also a continuation-in-part of U.S. patent application Ser. No. 11/038,000, which was filed on Jan. 18, 2005, now abandoned.

FIELD OF THE DISCLOSURE

The present disclosure relates generally to forms and, more particularly, to a foldable postcard form having a removable label.

BACKGROUND

It is common for company and government offices alike to mail to customers and area residents notices that may require a reply by the recipient. Where the reply includes confidential or semi-confidential information it is often appropriate for the reply to be enclosed in an envelope. Where confidential or semi-confidential information is not included in the reply, such as where the reply is a questionnaire or notice of address change, the reply may be in the form of a postcard to reduce postage charges for the reply. Indeed, postal rates for first class mailings differ substantially between letters and postcards. For non-automation mailings the difference in rates is currently $0.14. This provides a significant incentive to utilize postcards for a wide variety of specialized mailings;

It would be desirable for the outgoing mailer, including the notice or statement and the reply postcard, to itself qualify as a postcard to realize postal mail savings for a postcard versus first class mail. A duplex printed postcard using 0.007 inch cardstock has been developed for this purpose and is disclosed in commonly owned U.S. Pat. No. 5,667,134, the entire disclosure of which is incorporated herein by this reference. While the '134 patent discloses a double postcard structure that comprises a notable advantage and improvement in the art, it would be desirable to provide a double postcard structure which can be produced using simplex (1 side) printing. Further, in the manufacturing of business forms, it is often desirable to produce a form that holds a label that can be removed and adhered to another surface. For example, the Department of Motor Vehicles for a state may need a mailable form that holds a vehicle renewal sticker, which can be removed from the form and adhered to a recipient's license plate.

Typically, forms having a removable label are manufactured by adhering a release liner to a portion of the substrate of the form and adhering an adhesive backed removable label to the release liner. The problem with such a stacked construction is that the thickness of the form is increased by the thickness of the release liner, the adhesive(s) associated therewith, and the thickness of the removable label. Various problems occur with this design because a portion of the form is thicker than the remainder of the form. For example, the variation in thickness of the form could result in jams and other feeding, processing, and/or handling errors. Further, shipping and packaging time and costs increase because only a limited number of forms can be stacked before the stack becomes unstable and topples over. Also, the additional thickness increases the amount of packaging needed for a given number of forms. Still further, because the release liner and removable label are typically attached directly to a relatively thick and inflexible substrate, it is often difficult to remove the label from the form.

DETAILED DESCRIPTION

Figure 1:
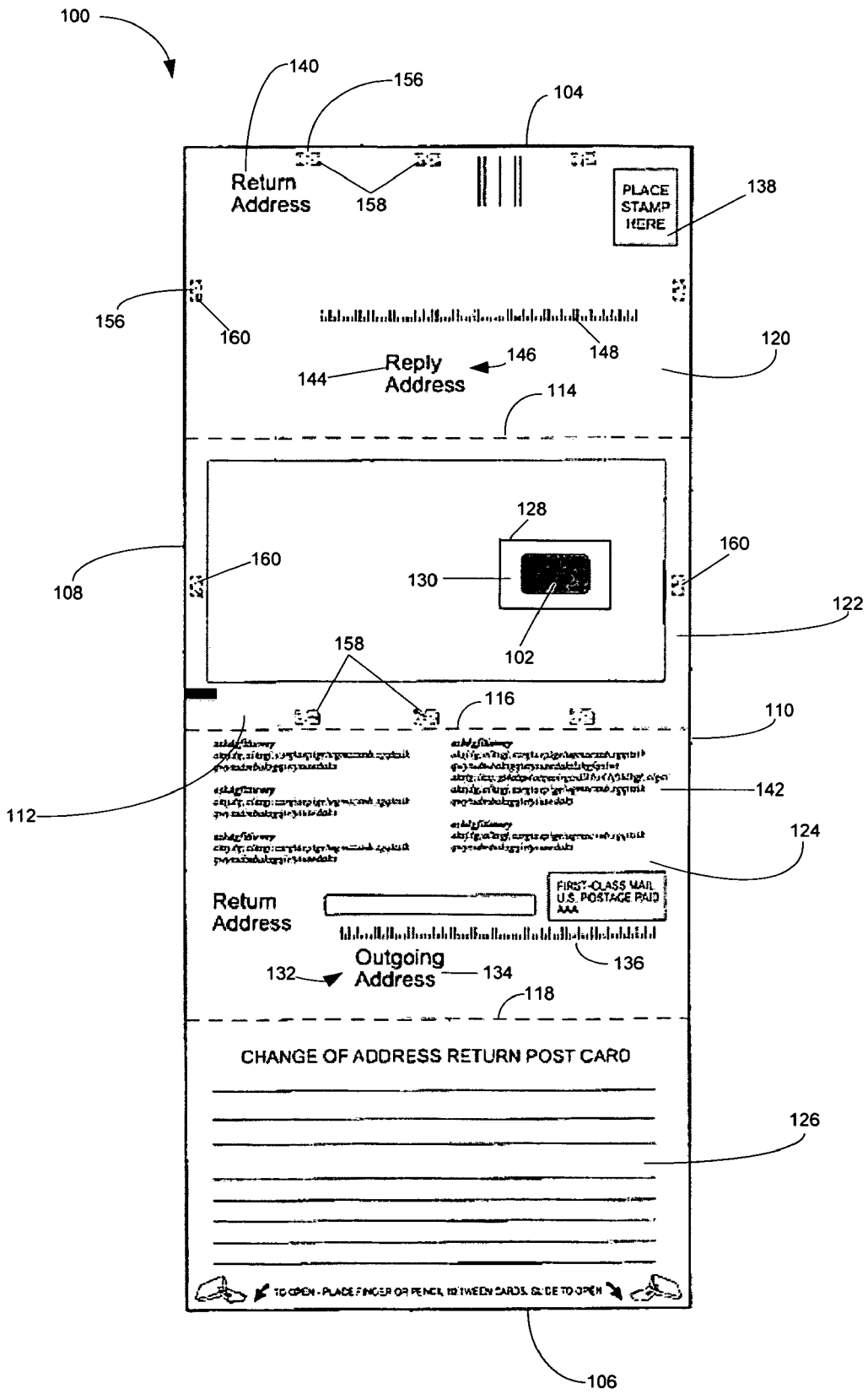
FIG. 1 is a plan view of a first face of an exemplary intermediate with a removable label structure.
Figure 2:
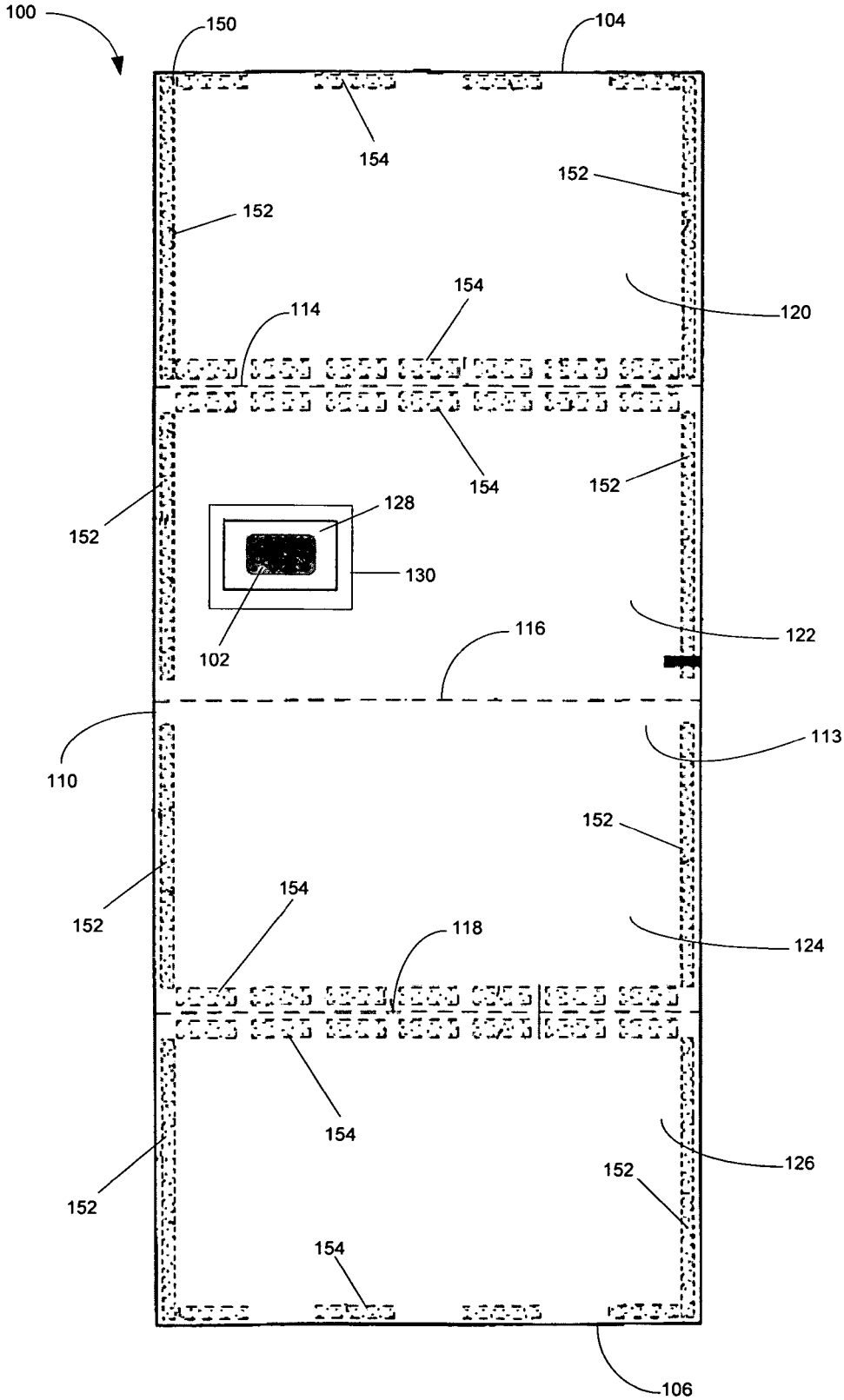
FIG. 2 is a plan view of the second face of the intermediate of FIG. 1.

An exemplary intermediate for a mailer-type business form 100 having a removable label 102 is shown in FIGS. 1 and 2. The form 100 includes a quadrate sheet of substantially opaque paper having parallel top and bottom edges 104, 106 and parallel first and second side edges 108, 110, respectively. The side edges 108, 110 are perpendicular to the top edge 104. The sheet further defines first and second faces 112, 113, which are depicted in FIGS. 1 and 2, respectively. First, second and third fold lines 114, 116, 118 are provided parallel to the top and bottom edges 104, 106 for dividing the sheet into four panels 120, 122, 124, 126. The first and fourth panels 120, 126 are of substantially equal size and the second and third panels 122, 124 are of substantially equal size. According to an example embodiment, as illustrated, all four panels 120, 122, 124, 126 are the same size. Further, in the example embodiment, the intermediate form 100 may be either a single cut sheet of 6"×14" or a continuous two-up 12"×14" sheet of, for example, 28# paper.

With reference to the illustrated embodiment, the first panel 120 is disposed as the top panel of the form 100, the second panel 122 is disposed as the second panel of the form 100, the third panel 124 is disposed as the third panel of the form 100 so that the second panel 122 is between the first and third panels 120, 124, and the fourth panel 126 is disposed as the bottom panel of the form 100 so that the third panel 124 is between the second and fourth panels 122, 126.

The example form 100 has a removable label 102 on the second panel 122. The removable label 102 on the second panel 122 may be, for example, a vehicle renewal sticker or other proprietary, confidential or semi-confidential information. An opening 128 is cut through the second panel 122. A liner 130 is attached to the second face 113 of the second panel 122. In the example of FIGS. 1 and 2, the liner 130 is attached so that it covers the entire opening 128. However, as discussed below, the liner 130 may only cover a portion of the opening 128. Further, the liner 130 may be adhered to the rear side 113 of the form 100 with strips of adhesive, spaced dots of adhesive or any other configuration of adhesive on any or all sides of the opening 128 as described in U.S. patent application Ser. No. 11/038,000, which is hereby incorporated herein in its entirety.

The removable label 102 is disposed on the liner 130 and within the opening 128 of the form 100. The label 102 is adhered to the liner 130 via a release coating (not shown), as described in the Ser. No. 11/038,000 application. The release coating interposes between the label 102 and the liner 130 so that the label 102 and the liner 130 can be separated without damaging the label 102. In some examples, the liner 130 may be coated with the release coating. In other examples, the face of the label 102 that faces the liner 130 may be coated with the release coating. In still further examples, the release coating may be disposed on a combination of the liner 130 and the label 102. Additionally, only a portion of the liner 130 and/or the label 102 may be coated with the release coating. The amount of release coating used need only be an amount sufficient to adhere the removable label 102 to the liner 130.

In addition to the release coating, other adhesive(s) may be used to join the label 102 to the liner 130 so that the label 102 can be removed without damage. For example, a pressure-sensitive removable adhesive could be used instead of or in addition to the release coating.

In this example, the opening 128 and the removable label 102 have similar rectangular shapes. However, the opening 128 and the removable label 102 may have any other desired shapes and, thus, their shapes may be substantially similar or substantially dissimilar to one another.

The liner 130 and the label 102 are moveable or displaceable (e.g., laterally and/or vertically) relative to the opening 128 in the form 100. There are several features of these embodiments that facilitate the removal of the removable label 102 from the liner 130. In particular, the liner 130 and the label 102 are laterally displaceable relative to the opening. Furthermore, the liner 130 is relatively flexible relative to the form 100. The flexibility of the liner 130 and the displaceablility of the liner 130 and the label 102 allow the recipient of the form 100 to easily remove the label 102 without damage. For example, the recipient can bend the liner 130 and peel back a portion (e.g., expose a free edge) of the label 102 so that the recipient can grasp the edge of the label 102 and remove the label 102 from the liner 130.

The example form 100 may also include a return postcard formed by the first and fourth panels 120, 126. The return postcard may be removed and mailed by the end user. Fold lines 114 and 118 may be lines of weakness that facilitate separation of the return postcard formed by the first and fourth panels 120, 126 (as described in greater detail below) from the second and third panels 122, 124. The fold lines 114 and 118 may be lines of weakness such as, for example, perforation lines or die cut lines. Fold line 116 may also comprise a line of weakness such as a perforated line or die cut line, or may be scored or creased to facilitate folding of the mailer because as presently proposed, the second and the third panels 122, 124 are permanently attached. As will be apparent below, the described series and orientations of panels 120, 122, 124, 126, is merely exemplary and other orientations are possible.

The form 100 includes an outgoing address area 132 on the first face 112 of the third panel 124. The outgoing address area 132 is dimensioned and adapted to receive, for example, a laser printed address or pre-printed address label. The outgoing address area 132 can include indicia corners or other indicators such as a change in texture, tone or color of the paper to facilitate the determination of the proper location of the outgoing address. Human readable address indicia, such as shown only schematically by indicia 134 in FIG. 1, is applied on the form 100, for example, as it is passed through a printer. Other human or machine readable indicia may also be printed or pre-printed on the first face of the third panel, such as postal address bar coding 136, indicia for postal stamp application 138 and/or indicia for the sender's return address 140. If deemed necessary or desirable, the postage 138, the return address 140 and the outgoing address 134 indicia may be confined, for example, to the lower half of the third panel 124 and the upper half portion of the third panel 134 may include legalese and/or instructions 142 for the recipient, particularly where the mailer is a tax related or other document for which the information in the removable label 102 on the second panel 122 must be in a prescribed format and/or otherwise fully occupy the second panel 122. FIG. 1 shows the panel 124 divided horizontally, with the addressing area 132 and bar coding 136 on the lower portion. Alternatively, the addressing area 132 and bar coding 136 may appear in the upper portion of panel 124. In yet another embodiment, the panel 124 may be divided vertically or in any other configuration such as for example, any configuration compliant with the standards detailed in the United States Postal Service Domestic Mail Manual.

In the illustrated embodiment, the first face 112 of the fourth panel 126 is pre-printed according to the type of return postcard provided. The first face 112 of the first panel 120 is also pre-printed or variably printed to include reply address indicia 144 in a reply address area 146. The reply address area 146 can include indicia corners or other indicators as described above with reference to the outgoing address area 132 to facilitate the determination of the proper location of the reply address 144 where such indicia is variably printed. Other human or machine readable indicia may also be printed or pre-printed on the first face 112 of the first panel 120. For example, postal address bar coding 148, indicia for postal stamp application and/or prepaid postal indicia 138, and a return address or lines for inserting return address at 140 may be printed or pre-printed on the first face 112.

In the illustrated embodiment, the indicia preprinted and variably printed on the first face 112 of the first and/or fourth panels 120, 126 is oriented in the same manner as the outgoing address indicia 134 provided on the first face 112 of the third panel 124. This facilitates the variable printing process. However, the indicia, particularly on the first face 112 of the first and fourth panels 120, 126, can be inverted from the orientation shown if deemed necessary or desirable for a particular application. In this regard, as will be understood from consideration of FIGS. 1, 3 and 4, when the form 100 is folded to form a mailer, the indicia provided on the first face 1 12 of the first panel 120 is inverted relative to the indicia provided on the first face 112 of the fourth panel 126. If it is preferred for a particular application to have the indicia on each face 112, 113 of the return postcard commonly oriented, either the indicia on the first face 112 of the first panel 120 or the indicia on the first face 112 of the fourth panel 126 can be inverted so that when the form 100 is folded, the indicia appears commonly directed on each face of the postcard.

In the illustrated embodiment, the first and fourth panels 120, 126 are adapted to together define a return postcard. To this end, at least a portion of the first panel 120 is adhered to at least a portion of the fourth panel 126 so that the mutually attached portions of the first and fourth panels 120, 126 each comprise one ply or layer of the postcard.

Figure 3:
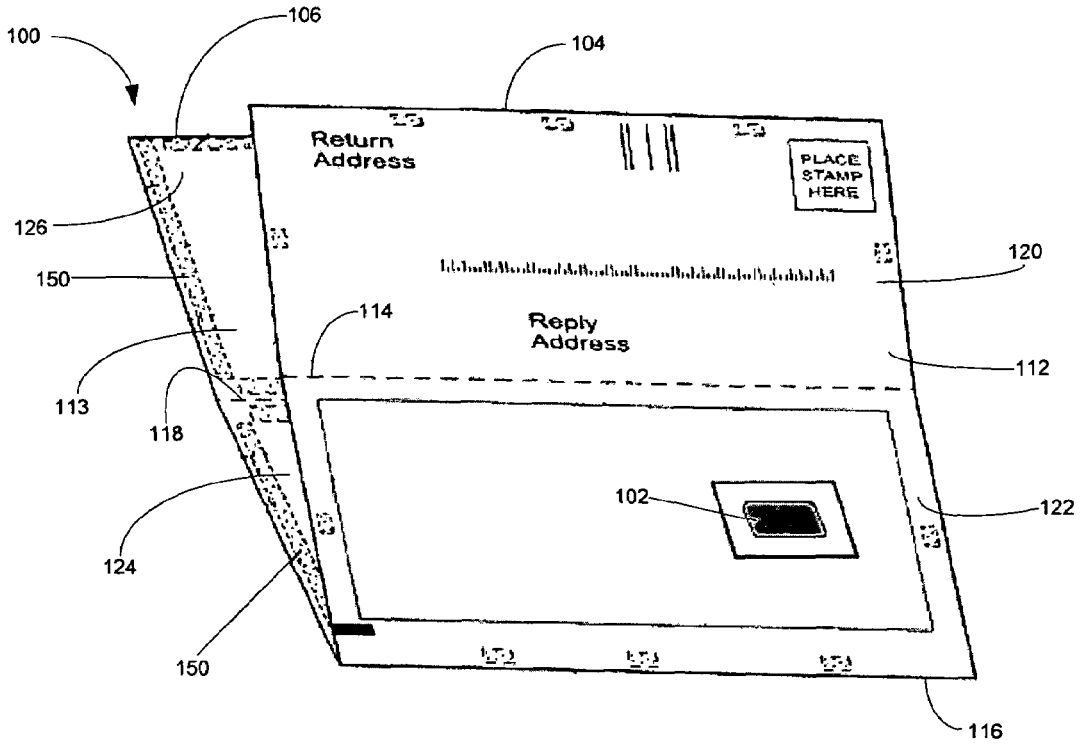
FIG. 3 is a perspective view showing the intermediate of FIG. 1 being folded to define a two postcard mailer.

Thus, the form 100 further includes, as shown in FIG. 2, a first plurality of adhesive patterns 150 provided along at least some of the edges of the panels 120, 122, 124, 126 for holding the first through fourth panels 120, 126 together as a double postcard structure when the sheet is folded about fold line 116, as illustrated in FIG. 3. In the illustrated example, the first adhesive patterns 150 include elongated strips 152 provided on the second face 113 of the first and/or fourth panels 120, 126 and on the second face 113 of the second and/or third panels, 122, 124. As illustrated, the first adhesive patterns 150 may also include adhesive strip(s) 154 on the second face 113 of the first panel 120 and/or the second face 113 of the fourth panel 126 adjacent the top and/or bottom edges 104, 106 of the respective panels 120, 126, and on the second face 113 of the second panel 122 and or the second face 113 of the third panel 124 adjacent fold lines 114 and/or 118, respectively. As an alternative to or in addition to strips 152, 154 about the perimeter of the sheet, adhesive may be provided within said perimeter.

Figure 4:
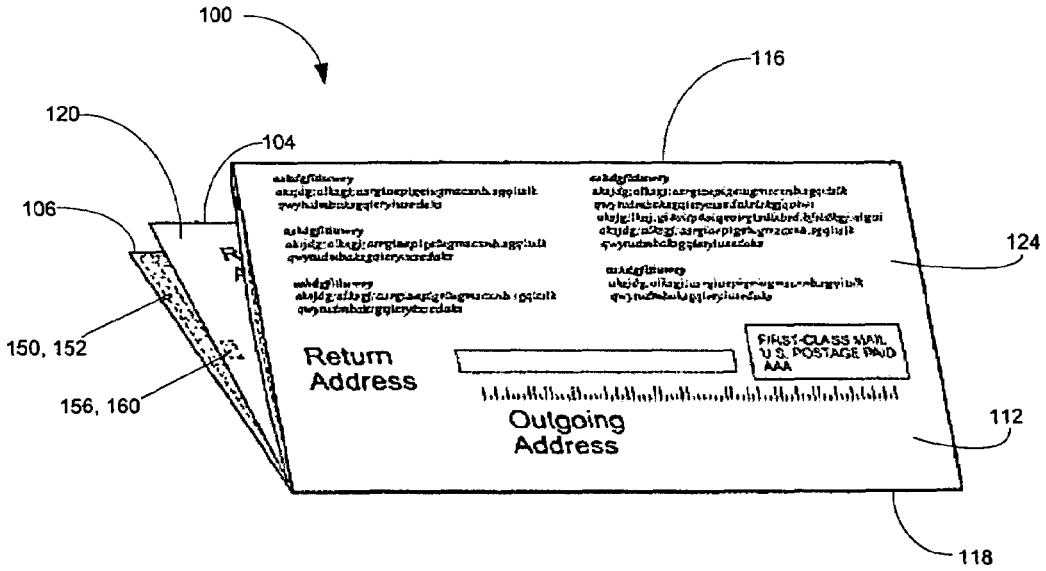
FIG. 4 is a perspective view showing the two postcard mailer of FIG. 3 being folded into an outgoing mailer.
Figure 5:
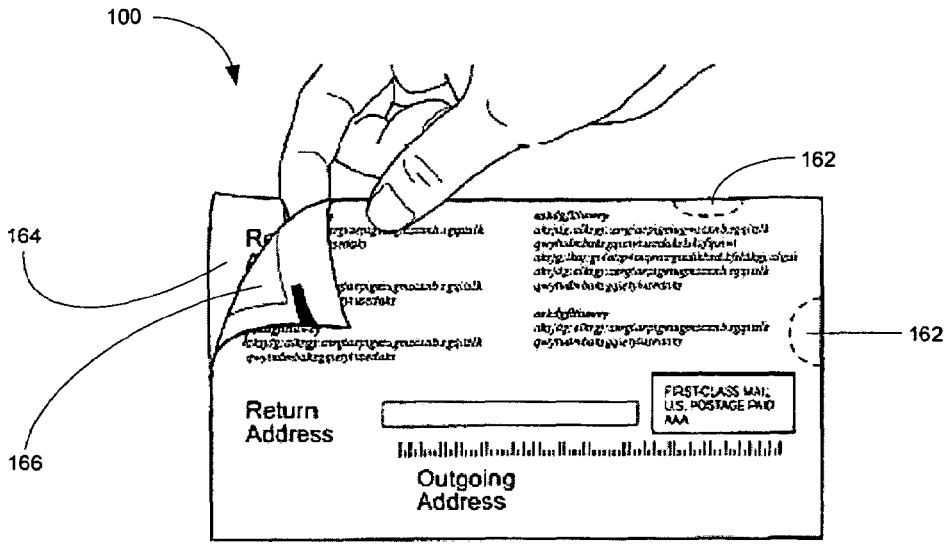
FIG. 5 is a perspective view showing the opening of the mailer of FIG. 4.

The adhesive patterns may also include a second plurality of adhesive patterns 156 for forming the outgoing mailer from the double postcards when the intermediate is folded about fold line 116, as shown in FIG. 4. In the illustrated embodiment, the second plurality of adhesive patterns 156 comprise adhesive spots or strips 158 provided on the first face 112 of the first panel 120 adjacent the top edge 104 and/or on the first face 112 of the second panel 122 adjacent line of weakness 116 to hold the first and second panels 120, 122 in opposed facing relation in the folded configuration. The second plurality of adhesive patterns 156 may also include adhesive spots or strips 160 provided on the first face 112 of the first panel 120 and/or on the first face 112 of the second panel 122 adjacent the side edges 108, 110. The configuration of the adhesive spots or strips 158, 160 may be of any dimension or shape or may be omitted. The use and configuration of the adhesive spots or strips 158, 160 may be guided by the standards set forth in the United States Postal Service Domestic Mail Manual. As an alternative, the second adhesive for holding the mailer may be provided by tabs 162 applied to the folded mailer, as shown in FIG. 5 and described herein below.

The first adhesive pattern 150 holding the form 100 in the double postcard configuration is a substantially permanent adhesive that is defined by pressure seal adhesive or cohesive for forming the double postcard structure upon folding and the application of suitable pressure to the adhesive region. However, the adhesive may alternatively be re-wettable adhesive, or a pressure sensitive adhesive covered by a release strip. Also, rather than continuous elements, the adhesive may be provided as discontinuous elements and/or in a pattern, shape or density other than that shown. However, the first adhesive pattern 150 for defining the double postcard is preferably substantially continuous to minimize or prevent delamination of the return postcard.

The second adhesive pattern 156 may be of any configuration including dashed lines, discontinuous dot configurations and the like. While the amount and spacing of such adhesive material should be at least sufficient to allow the mailer to be processed by automated U.S. Postal Service systems, the second adhesive pattern 156 may be minimized to facilitate opening of the mailer as described below and to minimize the surface damage to, and residual glue on, the return postcard.

Although not shown, detachable tractor drive strips may be provided on the form 100 during processing. Such strips may be conventionally formed and used to facilitate handling of the form 100 for printing or the like during manufacture of the mailer. The strips are typically provided where the form 100 is in continuous construction. In the present case, where the outgoing mailer is dimensioned and configured as a postcard (e.g. having a 6 inch width) the form 100 is a two-up form for continuous feed, so that the side edges 108, 110 are lines of weakness between longitudinally adjacent forms. During normal processing, such strips (not shown) are slit off or otherwise removed at an appropriate stage to define the top and bottom edges 104, 106. In constructing the mailer, after the form 100 is detached from the adjacent forms(s) continuously printed therewith (if any), and after slitting or removal of any tractor drive strips (if provided), the form is double V-folded as illustrated in FIGS. 3-4, typically by conventional folding equipment, and then processed by a suitable sealing machine (typically conventional equipment, either heat sealing or pressure sealing) to activate the first and second adhesive patterns 150, 156. Typically, the form shown in FIGS. 1 and 2 has a length between top and bottom edges 104, 106 of about 14 inches to produce a standard size postcard following double V-folding.

When the outgoing addressee receives the mailer, the mailer is then comprised of first and second plys 164, 166 with the first ply 164 being defined by the adhered first and fourth panels 120, 126 that comprise the return postcard, and the second ply 166 being defined by the adhered second and third panels 122, 124 that comprise the notice 166 for the recipient. Adhering the second and third panels 122, 124 protects the liner 130. Covering the liner 130, protects it from being caught, ripped or otherwise damaged or destroyed when the form 100 is being processed by a machine or handled by a careless person.

Figure 6:
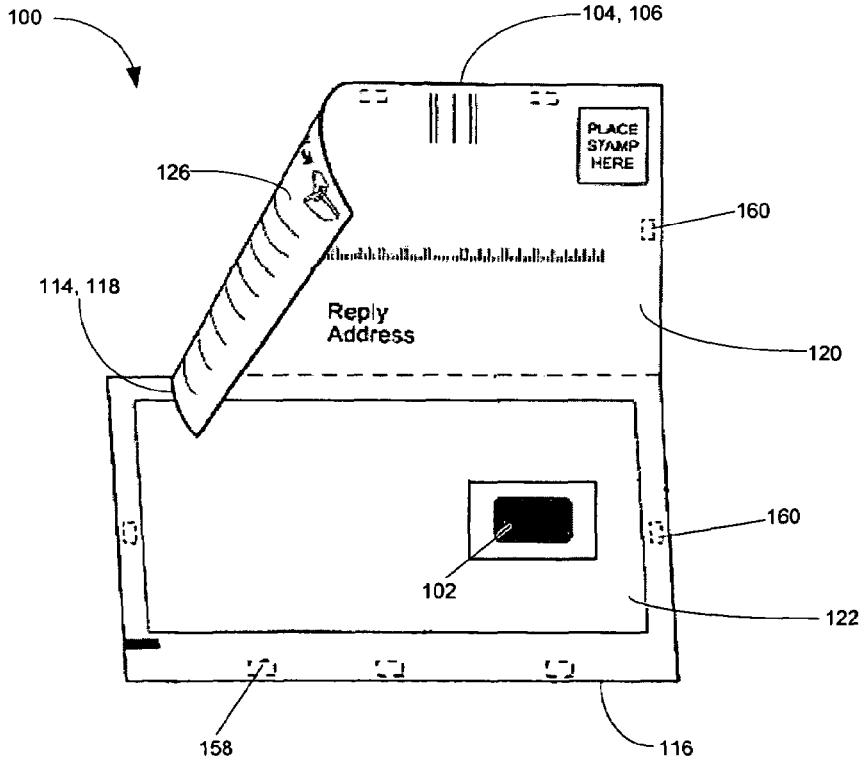
FIG. 6 is a perspective view of the open mailer of FIG. 4 showing the return postcard being removed.

The recipient can open the mailer to separate the postcard ply 164 from the notice 166 and reveal the removable label 102 by using a finger, pencil or letter opener to disrupt and separate adhesive spots 158, 160. As an alternative to all or some of adhesive spots 158, 160, the mailer may be held closed by edge tabs as shown at 162. Once the return postcard 164 has been separated from the notice 166, it can be removed by tearing along aligned lines of weakness 114, 118, as shown in FIG. 6.

Figure 7:
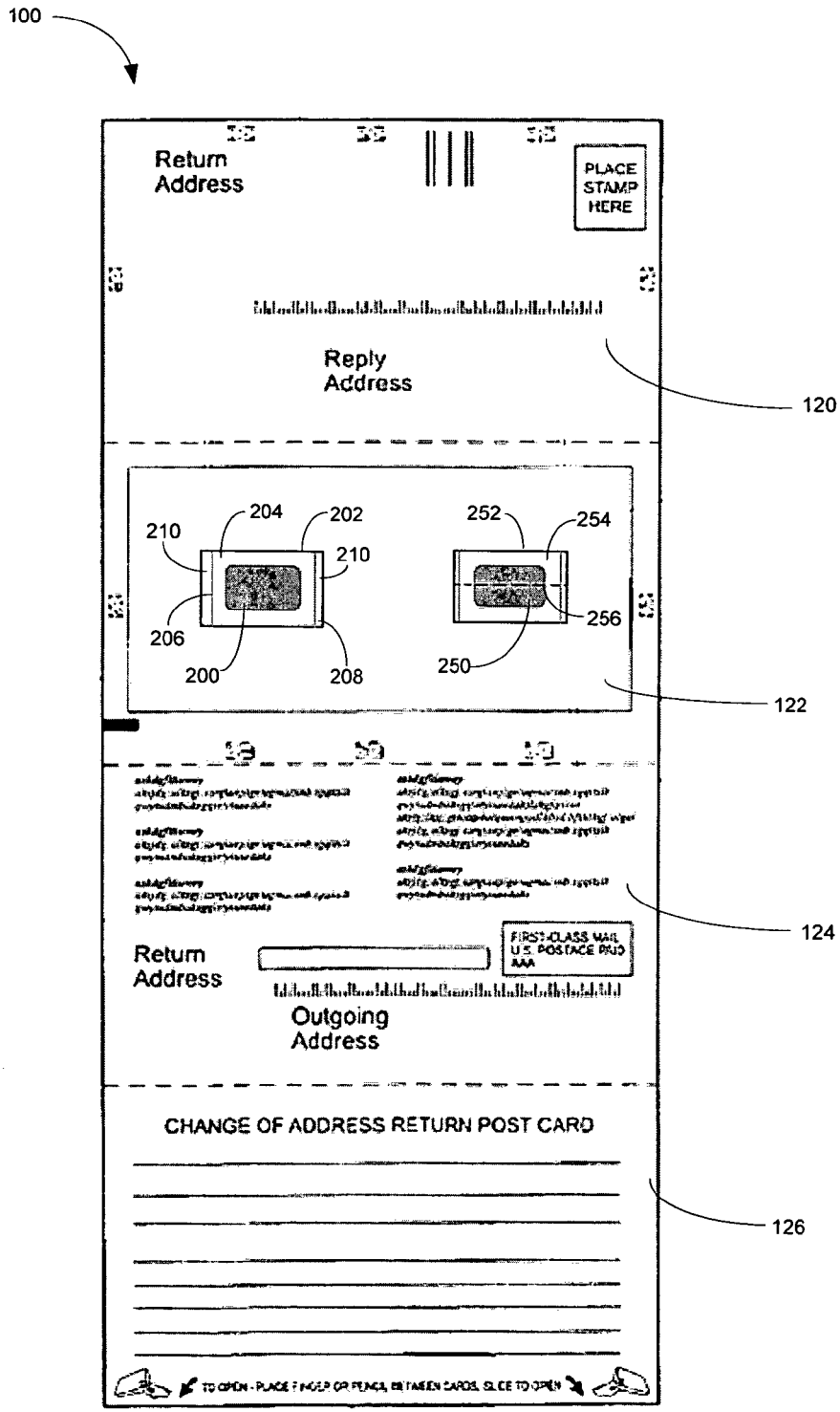
FIG. 7 is a plan view of a first face of an exemplary intermediate with two alternative removable label structures.

FIG. 7 shows a first alternative removable label 200. As shown in FIG. 7 the panel 122 has an opening 202 cut therethrough. A liner 204 is attached to the second face 113 of the panel 122 via adhesive as described above in connection with the label 102. In particular, the liner 204 is attached so that it covers only a portion of the opening 202 leaving sides 206, 208 of the liner 204 exposed.

The exposed sides 206, 208 do not extend to the inner edges of the opening 202, thereby leaving gaps 210 between the liner 204 and the panel 122 in the opening 202. The gaps 210 may be of various dimensions and numbers. For example, there may be one gap, or a plurality of gaps (as shown), or if a multi-piece liner is used (e.g., in a side-by-side configuration), there may be three or more gaps between the liner sections or pieces and the inner edges of the opening 202.

The gaps 210 impart substantial flexibility to liner 204 and, thus, enable the liner 204 and the label 200, which is coupled to the liner with a release coating as described above, to move (e.g., laterally) within the opening 202, which allows, for example, the liner 204 and the label 200 to center themselves in the opening 202. A further benefit to this construction is that less liner material and adhesive are needed, which reduces the cost of manufacture of the form 100.

FIG. 7 further shows that a plurality of labels, e.g., two, may be disposed within the panel 122. The second alternative removable label 250 is disposed within a second opening 252 on a second liner 254 in a manner similar to that described above. The second liner 254 has a perforation 256, which can be manipulated by the recipient of the form 100 to facilitate the removal of the label 250. For example, the recipient of the form 100 may tear the liner 254 along the perforation 256 to separate the liner 254 from the label 250. Once a portion of the label 250 is separated from the liner 254, the recipient may grasp that portion of the label 250 and continue to separate the liner 254 from the label 250. The perforation 256 is shown across the middle of the liner 254. However, the perforation 256 can be located anywhere on the liner 254, and there may be more than one perforation 256.

Figure 8:
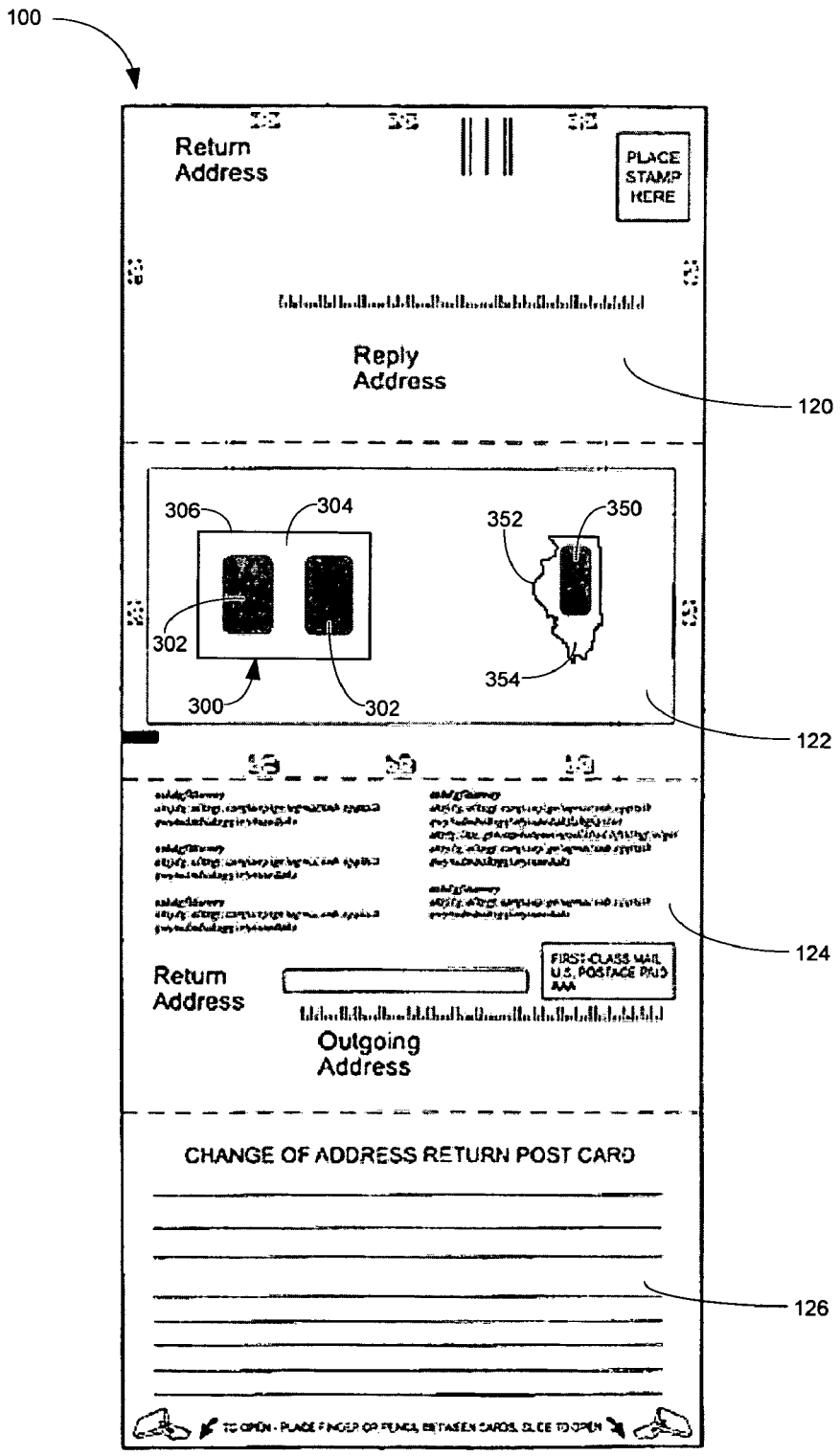
FIG. 8 is a plan view of a first face of an exemplary intermediate with a different two alternative removable label structures.

FIG. 8 illustrates a third alternative removable label configuration 300. In the third alternative configuration 300, a plurality of removable labels 302 may be disposed on a liner 304 in an opening 306 of the second panel 122 in a manner similar to that described above. Further, FIG. 8 illustrates a fourth alternative removable label 350. In this example, an opening 352 in the panel 122 has an aesthetically interesting shape. In the prior examples of FIGS. 1-7, the openings 128, 202, 252, 306 have rectangular shapes. However, in this example, the opening 352 is shaped like the state of Illinois. As shown here, the opening 352 has a substantially dissimilar shape than the label 350. Both the label 350 and/or the opening 352 may be any shape. For example, the label and the opening may have a shape corresponding to a geographic region, a state, a country, a logo, etc. The label 350 is coupled to a liner 354, which is adhered to the sides of the opening 352 in any manner described above.

Many example forms with various shaped openings, number of openings, shaped labels, number of labels, perforations and number of perforations have been described. Any combination of any of these characteristics is contemplated by these examples and through this disclosure. Further, the opening and labels described herein may appear on any and/or on multiple panels 120, 122, 124, 126 of the form 100.

Although certain example methods, apparatus and articles of manufacture have been described herein, the scope of coverage of this patent is not limited thereto. On the contrary, this patent covers all methods, apparatus and articles of manufacture fairly falling within the scope of the appended claims either literally or under the doctrine of equivalents.

What is claimed is:

1. A form for a postcard mailer, comprising:

a quadrate sheet having parallel top and bottom edges, parallel first and second side edges perpendicular to the top edge and first and second faces;

at least first, second, and third fold lines parallel to the top and bottom edges dividing the sheet into at least first, second, third and fourth panels, the first and fourth panels being substantially the same size and the second and third panels being substantially the same size;

an opening in at least one of the first, second, third and fourth panels;

a liner attached to the first face of the at least one panel to cover at least a portion of the opening, the liner having a line of weakness;

a label removably disposed on the liner in the opening; and first adhesive areas provided on the second face of at least one of the first and fourth panels, and on the second face of at least one of the second and third panels for adhering mutually facing portions of the second and third panels together as respective first and second postcard plies when the sheet is double V-folded about the fold lines.

2. A form as defined in claim 1, further comprising a second adhesive area for securing the first and second postcard plies together as an outgoing mailer.

3. A form as defined in claim 2, wherein said second adhesive area is defined on the first face of at least one of the first and second panels for holding the panels in opposed facing relation.

4. A form as defined in claim 1, wherein the first adhesive areas are provided about a periphery of the mutually facing portions.

5. A form as defined in claim 1, wherein the first adhesive areas provided on the second face of at least one of the first and fourth panels are provided adjacent side, top and bottom edges thereof, and the first adhesive areas provided on the second face of at least one of the second and third panels are provided adjacent side edges thereof.

6. A form as defined in claim 1, further comprising an outgoing address area defined on the first face of the third panel.

7. A form as defined in claim 1, further comprising an area for semi-confidential information on the first face of said second panel.

8. A form as defined in claim 1, further comprising a reply address area defined on the first face of one of the first and fourth panels.

9. A form as defined in claim 1, further comprising another opening in one of the first, second, third or fourth panels.

10. A form as defined in claim 1, further comprising another label removably disposed on the liner.

11. A form as defined in claim 1, wherein the line of weakness is a perforation.

12. A form as defined in claim 11, wherein the liner includes a second perforation.

13. A form as defined in claim 1, wherein the shape of the opening corresponds to a geographic region, a state, a country or a logo.

14. A form as defined in claim 1, wherein the label and the opening have substantially similar shapes.

15. A form as defined in claim 1, wherein the label and the opening have substantially dissimilar shapes.

16. A form as defined in claim 1, wherein the liner is displaceable relative to the opening.

17. A form for a postcard mailer, comprising:

a quadrate sheet having parallel top and bottom edges, parallel first and second side edges perpendicular to the top edge and first and second faces;

at least first, second, and third fold lines parallel to the top and bottom edges dividing the sheet into at least first, second, third and fourth panels, the first and fourth panels being substantially the same size and the second and third panels being substantially the same size;

an opening in at least one of the first, second, third and fourth panels;

a liner attached to the first face of the at least one panel to cover at least a portion of the opening, wherein the liner is not attached to the at least one panel at one edge of the opening;

a label removably disposed on the liner in the opening; and first adhesive areas provided on the second face of at least one of the first and fourth panels, and on the second face of at least one of the second and third panels for adhering mutually facing portions of the second and third panels together as respective first and second postcard plies when the sheet is double V-folded about the fold lines.

18. A form as defined in claim 17, wherein the liner is displaceable relative to the opening.

19. A double postcard size mailer including an integral laminated postcard size reply mail piece which is detachable from the mailer, the mailer comprising:

a quadrate sheet having parallel top and bottom edges, parallel first and second side edges perpendicular to the top edge and first and second faces;

at least first, second and third fold lines parallel to the top and bottom edges dividing the sheet into at least first, second, third, and fourth panels, said first and fourth panels being substantially the same size and the second and third panels being substantially the same size;

an opening in at least one of the first, second, third and fourth panels;

a liner attached to the first face of the at least one panel to cover at least a portion of the opening;

a label removably disposed on the liner in the opening, the liner having a line of weakness;

first adhesive areas provided on the second face of at least one of the first and fourth panels, and on the second face of at least one of the second and third panels for substantially permanently adhering mutually facing portions of the first and fourth panels and mutually facing portions of the second and third panels together as respective first and second postcard plies when the sheet is double V-folded about the fold lines;

a second adhesive area for securing the first and second postcard plies together as an outgoing mailer; and the sheet being folded such that the second surfaces of the first and fourth panels lie in contact and are adhered together by the first adhesive areas to form the postcard size reply mail piece, the second surfaces of the second and third panels lie in contact and are adhered together by the first adhesive areas to define a postcard size outgoing mail piece, and the first surfaces of the first and second panels lie in contact and are held together by the second adhesive area.

20. A double postcard size mailer as defined in claim 19, wherein the second adhesive area is defined on the first face of at least one of the first and second panels for holding the panels in opposed facing relation.

21. A double postcard size mailer as defined in claim 19, wherein the second adhesive area includes at least one adhesive tab for holding mutually aligned edges of the first and second postcard plies together as an outgoing mailer.

22. A double postcard size mailer as defined in claim 19, wherein the first adhesive areas are provided about a periphery of the mutually facing portions.

23. A double postcard size mailer as defined in claim 19, wherein the first adhesive areas provided on the second face of at least one of the first and fourth panels are provided adjacent side, top and bottom edges thereof, and the first adhesive areas provided on the second face of at least one of the second and third panels are provided adjacent side edges thereof.

24. A double postcard size mailer as defined in claim 19, wherein the first adhesive areas include pressure sensitive adhesive.

25. A double postcard size mailer as defined in claim 19, farther comprising another opening in any of the first, second, third or fourth panels.

26. A double postcard size mailer as defined in claim 19, wherein there is another label removably disposed on the liner.

27. A double postcard size mailer as defined in claim 19, wherein the line of weakness is a perforation.

28. A double postcard size mailer as defined in claim 27, wherein the liner includes a second perforation.

29. A double postcard size mailer as defined in claim 19, wherein the shape of the opening corresponds to a geographic region, a state, a country or a logo.

30. A double postcard size mailer as defined in claim 19, wherein the label and the opening have substantially similar shapes.

31. A double postcard size mailer as defined in claim 19, wherein the label and the opening have substantially dissimilar shapes.

32. A double postcard size mailer as defined in claim 19, wherein the liner is displaceable relative to the opening.

33. A double postcard size mailer including an integral laminated postcard size reply mail piece which is detachable from the mailer, the mailer comprising:

a quadrate sheet having parallel top and bottom edges, parallel first and second side edges perpendicular to the top edge and first and second faces;

at least first, second and third fold lines parallel to the top and bottom edges dividing the sheet into at least first, second, third, and fourth panels, said first and fourth panels being substantially the same size and the second and third panels being substantially the same size;

an opening in at least one of the first, second, third and fourth panels;

a liner attached to the first face of the at least one panel to cover at least a portion of the opening wherein the liner is not attached to the at least one panel at one edge of the opening;

a label removably disposed on the liner in the opening;

first adhesive areas provided on the second face of at least one of the first and fourth panels, and on the second face of at least one of the second and third panels for substantially permanently adhering mutually facing portions of the first and fourth panels and mutually facing portions of the second and third panels together as respective first and second postcard plies when the sheet is double V-folded about the fold lines;

a second adhesive area for securing the first and second postcard plies together as an outgoing mailer; and the sheet being folded such that the second surfaces of the first and fourth panels lie in contact and are adhered together by the first adhesive areas to form the postcard size reply mail piece, the second surfaces of the second and third panels lie in contact and are adhered together by the first adhesive areas to define a postcard size outgoing mail piece, and the first surfaces of the first and second panels lie in contact and are held together by the second adhesive area.

34. A double postcard size mailer as defined in claim 33, wherein the liner is displaceable relative to the opening.

* * * * *